US005253369A

United States Patent [19]

Patterson, Jr.

[11] Patent Number: 5,253,369

[45] Date of Patent: Oct. 19, 1993

[54] METHOD OF MAKING A REVERSIBLE SCARF WITH VISOR

[76] Inventor: William H. Patterson, Jr., P.O. Box 446, Watkins, Colo. 80137-0146

[21] Appl. No.: 974,154

[22] Filed: Nov. 10, 1992

[51] Int. Cl.[5] ..... A42B 5/00

[52] U.S. Cl. ..... 2/207; 2/195.6; 2/200.1

[58] Field of Search ..... 2/171, 172, 175, 192, 2/194, 195, 196, 198, 207, 209.1

[56] References Cited

U.S. PATENT DOCUMENTS

| | | | |
|---|---|---|---|
| 2,005,361 | 6/1935 | Rollins | 2/198 |
| 2,859,448 | 11/1958 | Gnichel | 2/207 |
| 3,480,970 | 12/1969 | Gettinger | 2/198 |
| 4,686,713 | 8/1987 | Coleman | 2/195 |

FOREIGN PATENT DOCUMENTS

| | | | |
|---|---|---|---|
| 1003368 | 3/1952 | France | 2/198 |
| 811084 | 4/1959 | United Kingdom | 2/207 |

*Primary Examiner*—Clifford D. Crowder
*Assistant Examiner*—Diana L. Biefeld

[57] ABSTRACT

A method of making a reversible scarf with visor includes the steps of: (1) cutting two identical size crescent-shape fabric pieces from two different materials; (2) providing a crescent-shape flexible polycarbonate or equivalent stiffener; (3) placing the two crescent-shape fabric pieces in overlying wrong-side-out orientation; (4) stitching the two crescent-shape fabric pieces together along their convex edges to form an envelope; (5) turning the envelope right-side-out; (6) inserting the stiffener into the envelope; (7) stitching around the entire periphery of the envelope, through the stiffener, to form a visor; (8) cutting two identical size isosceles right triangle-shape fabric pieces from two different materials; (9) placing the two triangular fabric pieces in overlying wrong-side-out orientation; (10) placing the visor between the triangular fabric pieces, with a concave edge of the visor disposed centrally between two vertices on a hypotenuse of the triangular fabric pieces; (11) stitching around the periphery of the overlying triangular fabric pieces and through the concave edge of the visor to form a scarf, leaving an unsewn peripheral gap; (12) turning the scarf right-side-out by pulling the visor through the unsewn gap; and (13) stitching around the periphery of the scarf and through the concave edge of the visor. The completed scarf with visor has opposite sides with two different patterns and/or colors, allowing the scarf to be selectively reversed to provide two different ornamental appearances, due to the flexible nature of the visor.

20 Claims, 4 Drawing Sheets

METHOD OF MAKING A REVERSIBLE SCARF WITH VISOR

BACKGROUND OF THE INVENTION

The present invention relates to apparel adapted to be worn on the head, and more particularly pertains to a method for making a reversible scarf with visor.

SUMMARY OF THE INVENTION

The present invention provides a method of making a reversible scarf with visor which includes the steps of: (1) cutting two identical size crescent-shape fabric pieces from two different materials; (2) providing a crescent-shape flexible polycarbonate stiffener; (3) placing the two crescent-shape fabric pieces in overlying wrong-side-out orientation; (4) stitching the two crescent-shape fabric pieces together along their convex edges to form an envelope; (5) turning the envelope right-side-out; (6) inserting the stiffener into the envelope; (7) stitching around the entire periphery of the envelope, through the stiffener, to form a visor; (8) cutting two identical size isosceles right triangle-shape fabric pieces from two different materials; (9) placing the two triangular fabric pieces in overlying wrong-side-out orientation; (10) placing the visor between the triangular fabric pieces, with a concave edge of the visor disposed centrally between two vertices on a hypotenuse of the triangular fabric pieces; (11) stitching around the periphery of the overlying triangular fabric pieces and through the concave edge of the visor to form a scarf, leaving an unsewn peripheral gap; (12) turning the scarf right-side-out by pulling the visor through the unsewn gap; and (13) stitching around the periphery of the scarf and through the concave edge of the visor. The completed scarf with visor has opposite sides with two different patterns and/or colors, allowing the scarf to be selectively reversed to provide two different ornamental appearances, due to the flexible nature of the visor. The scarf with visor may be folded or rolled from the right angle vertex toward the visor and tied around a wearer's head in the manner of a sweatband. Alternatively, the scarf with visor may be tied over a wearer's head to form a head covering with visor, somewhat in the manner of a conventional scarf.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT(S)

Figure 1:
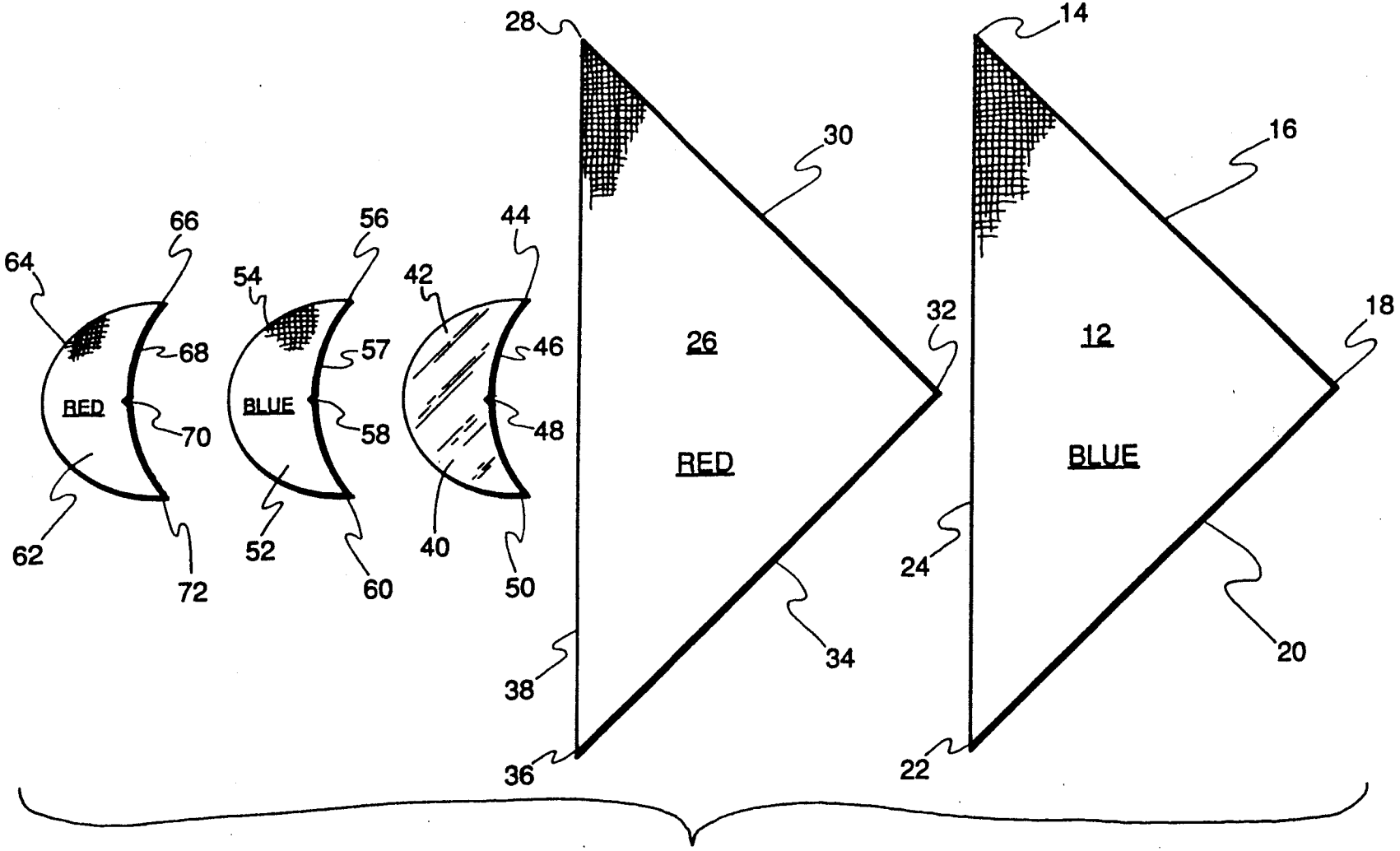
FIG. 1 is a plan view of the fabric and stiffener components used in making the reversible scarf with visor according to the method of the present invention.
Figure 7:
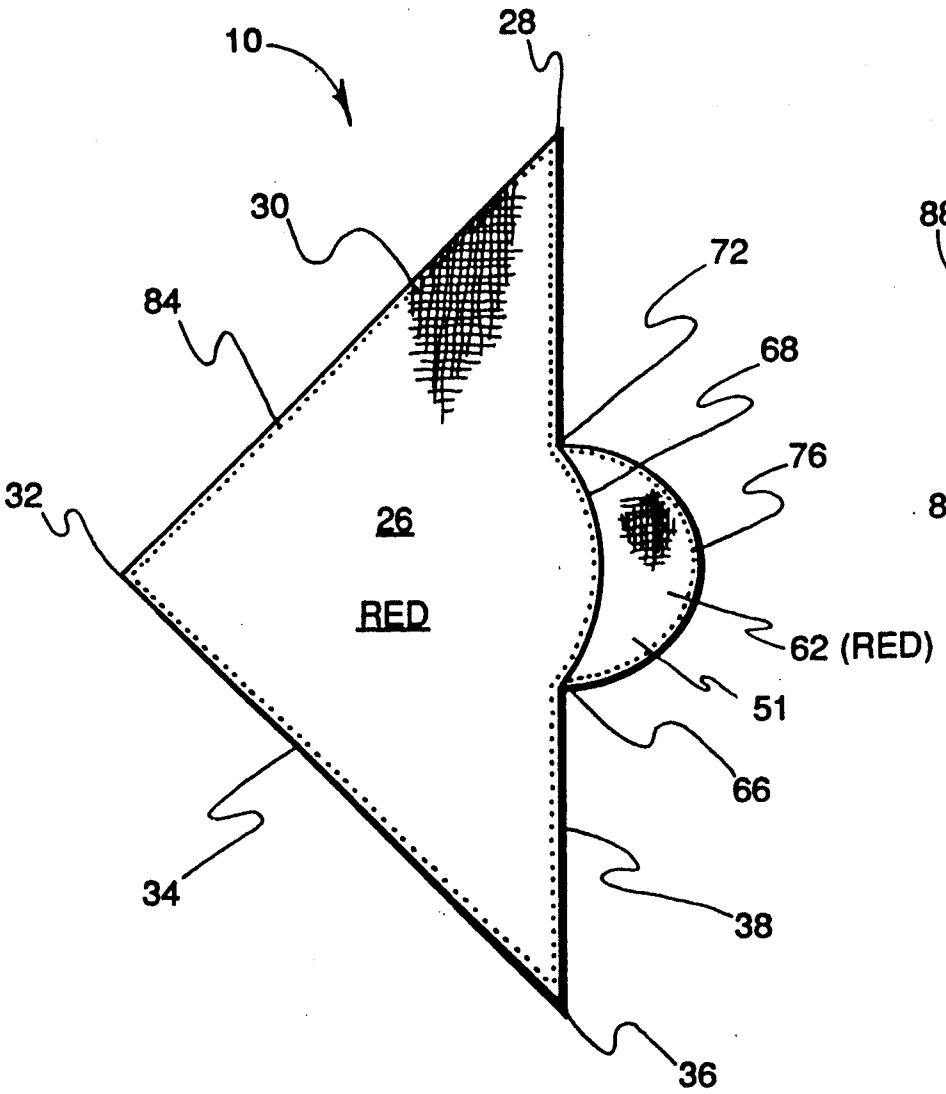
FIG. 7 is a plan view illustrating the completed reversible scarf with visor made by the method of the present invention.

Referring now to the drawings, wherein like reference numerals designate corresponding structure throughout the views, and referring in particular to FIG. 1, the method of making a reversible scarf with visor 10 (FIGS. 7 and 8) according to the present invention begins with the steps of providing component parts, e.g., by cutting from sheet stock materials, for subsequent assembly. The component parts include a first isosceles right triangle-shaped scarf body fabric piece 12 possessing a vertex 14 connected to right angle vertex 18 by a first short side 16. A second short side 20 extends from vertex 18 to vertex 22. A long side or hypotenuse 24 extends between vertex 14 and vertex 22. A substantially identically dimensioned second scarf body fabric piece 26 includes vertices 28, 32, 36 and sides 30, 34, and 38. The pieces 12 and 26 are preferably dimensioned such that the short sides possess an equal length in the range of twenty-four to twenty-eight inches. The scarf body fabric pieces 12 and 26 are desirably formed from different materials so as to present different ornamental visual appearances. The phrase "formed from different materials" as used in this description of the invention also includes materials of the same fabric composition, but having different textures, patterns, or colors. For simplicity of illustration, scarf body fabric piece 12 has been denoted as "BLUE" in color, while scarf body fabric piece 26 has been denoted as "RED" in color, in order to illustrate this ornamental reversible feature.

A visor stiffener 40 is preferably formed from a flexible transparent polycarbonate material or the equivalent having a thickness of 0.0035 inches. Such polycarbonate and equivalent sheet materials can be sewn through without cracking. The stiffener 40 is crescent-shaped and includes corners 44 and 50 connected by convex 42 and concave 46 peripheral edge portions. A V-shaped alignment notch 48 is formed at the midpoint of the concave edge 46.

A first crescent-shaped visor body fabric piece 52 possesses corners 56 and 60 connected by convex 54 and concave 57 peripheral edge portions. A V-shaped alignment notch 58 is formed at the midpoint of the concave edge 46. A second crescent-shaped visor body fabric piece 62 possesses corners 66 and 72 connected by convex 64 and concave 68 peripheral edge portions. A V-shaped alignment notch 70 is formed at the midpoint of the concave edge 46. The visor body fabric pieces 52 and 62 are formed from two different materials so as to present different ornamental appearances. For example, the visor body fabric pieces 52 and 62 may be formed from the same two materials as the scarf body fabric pieces 12 and 26. For simplicity of description, visor body fabric piece 52 is denoted as "BLUE" in color, and visor body fabric piece 62 as "RED" in color, to emphasize the two distinct visual ornamental appearances. The concave edges 46, 57, and 68 of the stiffener 40 and visor body fabric pieces 52 and 62 are preferably contoured for conformance with a human forehead. Accordingly, several different sizes may be provided to accommodate different head sizes.

Figure 2:
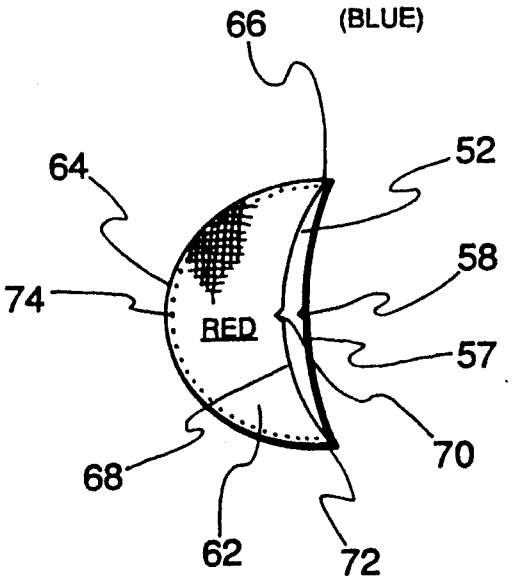
FIG. 2 is a plan view illustrating the manner of forming the fabric visor envelope of the reversible scarf with visor.

With reference to FIG. 2, the visor body fabric pieces 52 and 62 are placed in overlying relation, in a wrong-side-out orientation. The term "wrong-side-out orientation" means that the fabric pieces 52 and 62 are placed such that the sides of the pieces 52 and 62 intended to be ultimately visible upon completion of the scarf with visor initially face one another, and are thus substantially hidden from view. With fabrics having identical opposite sides, "wrong-side-out orientation" is of course not essential, due to the identical visual ornamental appearance of the opposite sides of the fabric. Alignment notches 58 and 70 facilitate proper orientation of the visor body fabric pieces 52 and 62, in that notches 58 and 70 are juxtaposed upon proper alignment. After alignment has been completed, a seam 74 is sewn from corner 66 along convex edge 64 to corner 72, forming an inside out envelope possessing an opening along concave edges 57 and 68.

Figure 3:
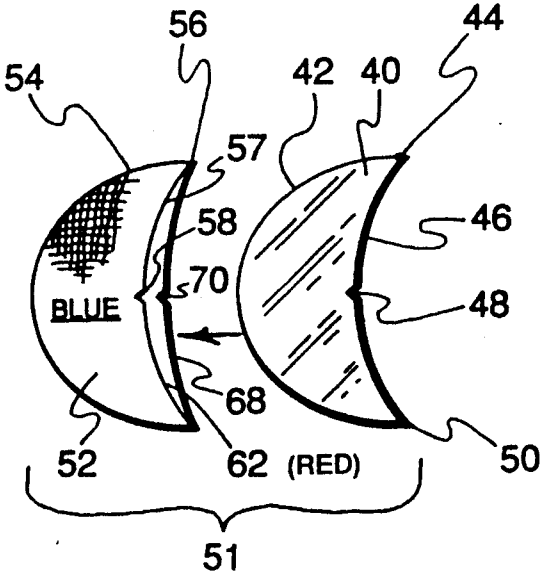
FIG. 3 is an exploded plan view illustrating the manner of inserting the stiffener into the fabric visor envelope.

After completion of the seam 74, the envelope is inverted (turned right-side-out) as shown in FIG. 3, hiding the seam 74 and exposing the intended ornamental faces of the visor body fabric pieces 52 and 62. The stiffener 40 is then inserted into the opening of the envelope extending along concave edges 57 and 68, aligning notches 58, 48, and 70, and forming a visor 51 possessing one blue color face and an opposite red color face.

Figure 4:
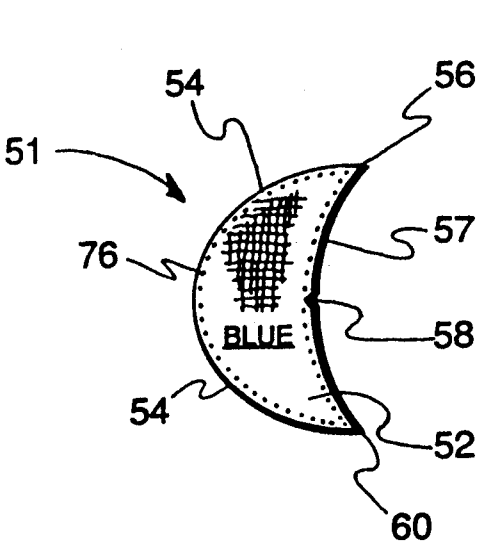
FIG. 4 is a plan view illustrating the completed visor.

As depicted in FIG. 4, a seam 76 is then sewn around the entire periphery of the visor 71, through visor body fabric piece 52, stiffener 40, and visor body fabric piece 52, closing the envelope opening and securing the stiffener 40 against slippage.

Figure 6:
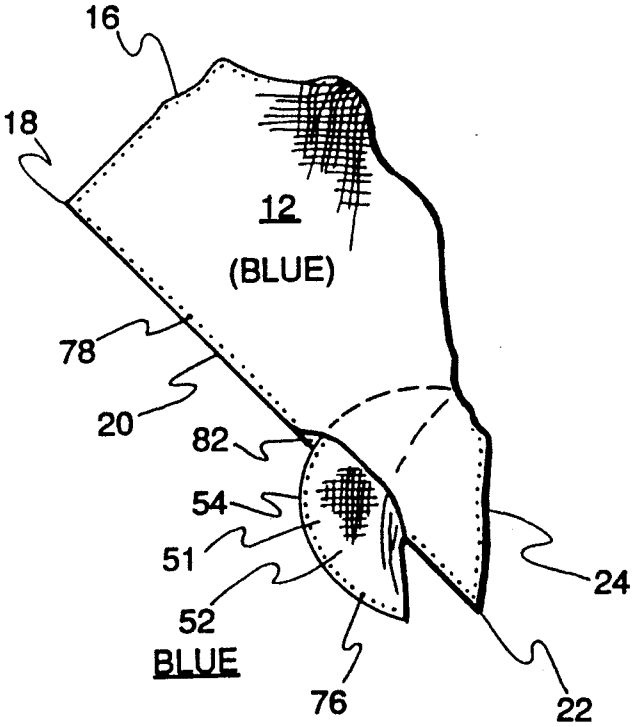
FIG. 6 is a plan view illustrating the step of turning the scarf right-side-out by pulling the attached visor through an unsewn peripheral gap.
Figure 5:
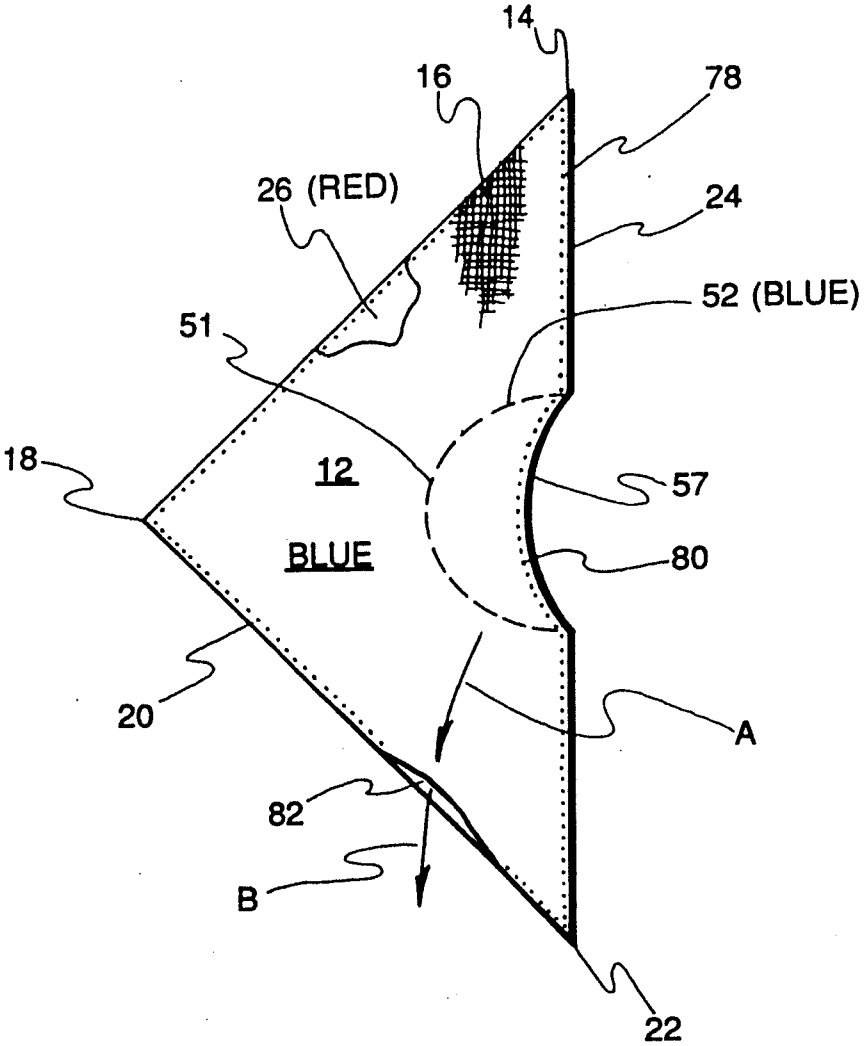
FIG. 5 is a plan view illustrating the manner of forming the scarf body and the attachment of the visor thereto.

With reference now to FIG. 5, the scarf body pieces 12 and 26 are placed in overlying, wrong-side-out orientation, with the visor 51 sandwiched therebetween. The visor 51 is oriented with the concave edge 57 disposed substantially centrally between two vertices 14 and 22 and on or adjacent the hypotenuse 24 of the triangle. Inasmuch as the scarf body fabric pieces 12 and 26 are disposed in wrong-side-out orientation, the intended ornamental display faces of the visor 51 face and lie against the intended associated ornamental display faces of the fabric pieces 12 and 26. For example, in the illustrated embodiment, the intended display face of blue scarf body fabric piece 12 faces and lies against the intended display face of the blue visor body fabric piece 52 of visor 51. After proper orientation has been effected, a seam 78 is sewn around the periphery of the triangle, through both overlying scarf body fabric pieces 12 and 26, and through the concave edge 57 of the visor 51. The sides 24 and 38 of the pieces 12 and 26 conform to the arcuate curvature during sewing along the concave edge 57 of the visor 51. Preferably, the seam 78 extends through both visor body fabric pieces 52 and 62, as well as stiffener 40, for a maximum strength connection of the visor 51 to the scarf. The seam 78 does not extend entirely around the periphery of the triangle, but is rather truncated to leave an unsewn gap 82 possessing a length sufficient to allow passage of visor 51 therethrough. Instead of leaving an unsewn portion, the seam 78 may alternatively be entirely completed around the periphery and subsequently cut open to form the gap 82. Next, the worker reaches through the gap 82 and grasps the visor 51, pulling it in the direction indicated by arrows A and B through the gap 82. FIG. 6 illustrates the configuration of the scarf with the visor 51 partially withdrawn through the gap 82. The worker continues pulling the visor 51 until the entire scarf has been turned right-side-out through the gap 82, hiding the seam 78 and the cut edges of the scarf body fabric pieces 12 and 26.

The scarf with visor 10 is then straightened and substantially flattened, resulting in the configuration shown in FIG. 10. A final seam 84 is sewn around the entire periphery of the scarf and through the concave edge 68 of the visor 51, and also closing the gap 82. The intended display faces of the fabric pieces 26 and 6 (RED) and fabric pieces 12 and 52 (BLUE) are now oriented such that the scarf 10 may be reversed to provide two different ornamental appearances merely by turning the scarf 10 over.

Figure 8:
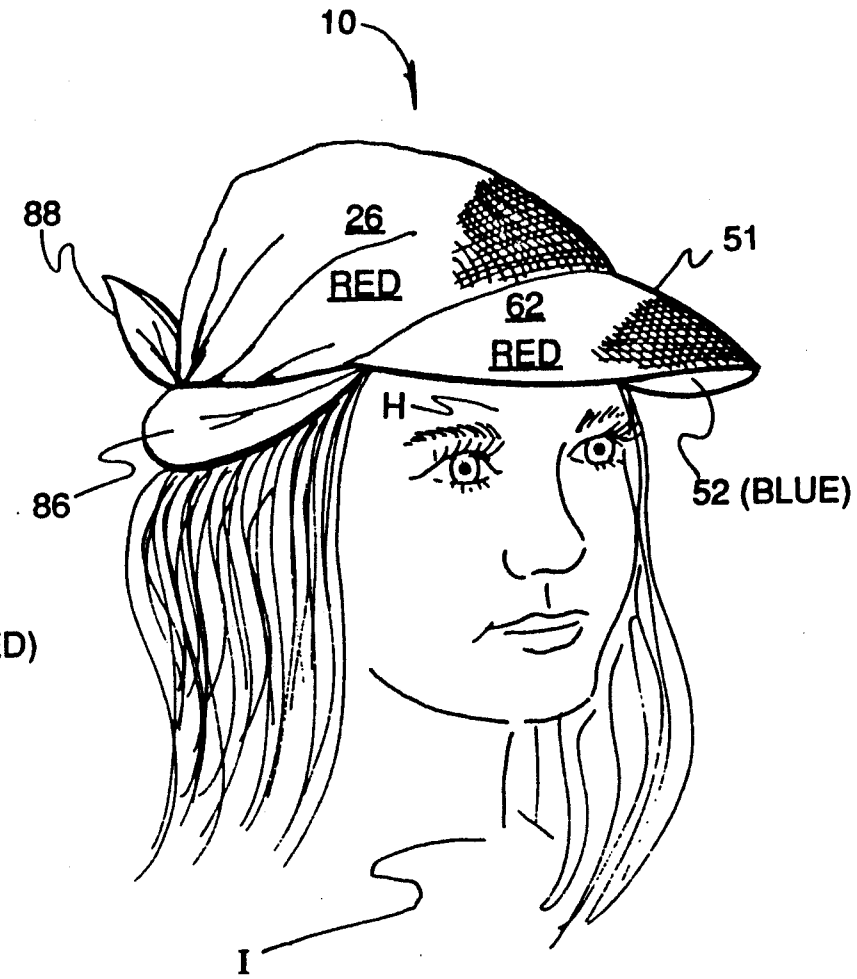
FIG. 8 is a perspective view illustrating an example manner of wearing the reversible scarf with visor made by the method of the present invention.

The manner of wearing the scarf 10 is of course dependent upon the individual taste of the user. An example manner of wearing the scarf 10 is shown in FIG. 8, in which the scarf is partially rolled or folded at 86 and knotted at 88 to form a head covering for the head H of an individual I. In another alternative manner of wear, the body of the scarf 10 may be entirely rolled or folded to form a head band with an attached visor 51. The scarf 10 may be conveniently folded or rolled for transportation or storage without permanent deformation, due to the flexible nature of the stiffener 40.

While the preferred embodiment of the invention has been described with reference to the use of sewing techniques to form the various fabric connections, it should be understood that other fastening techniques may be employed within the scope of the invention. Examples of such alternative fasteners include adhesives, seam binding tape, heat welding, staples, and clips.

Additionally, while the visor body fabric pieces and stiffener have been illustrated as crescent-shape, a myriad of other shapes may be employed without departing from the scope of the invention. Similarly, while the scarf body fabric pieces have been depicted as isosceles right triangles, a wide variety of other polygonal and curvilinear shapes may be utilized within the scope of the invention.

As an alternative to utilization of a visor including a stiffener disposed in a fabric envelope, a single piece visor assembly may be employed. For example, a visor of a tinted flexible plastic or polycarbonate or equivalent material may be utilized. In this context, the visor would be directed secured to the edges of the scarf body fabric pieces, in the absence of any fabric visor body pieces.

It is to be understood, however, that even though numerous characteristics and advantages of the present invention have been set forth in the foregoing description, together with details of the structure and function of the invention, the disclosure is illustrative only, and changes may be made in detail, especially in matters of materials, shape, size and arrangement of parts within the principles of the invention to the full extent indicated by the broad general meaning of the terms in which the appended claims are expressed.

What is claimed is:

1. A method of making a scarf with visor, comprising the steps of:

(1) providing two visor body fabric pieces;
(2) providing a stiffener;
(3) placing said two visor body fabric pieces in substantially overlying relation;
(4) securing said two visor body fabric pieces together along a portion of their peripheral edges to form an envelope;
(5) inserting said stiffener into said envelope;
(6) providing two scarf body fabric pieces;
(7) placing said two scarf body fabric pieces in substantially overlying relation;
(8) placing said visor between said scarf body fabric pieces, with an edge portion of said visor disposed adjacent substantially overlying peripheral edges of said scarf body fabric pieces;
(9) securing peripheral edges of said substantially overlying scarf body fabric pieces and said edge portion of said visor to form a scarf, leaving a peripheral gap; and
(10) turning said scarf right-side-out by pulling said visor through said gap.

2. The method of claim 1, wherein said visor body fabric pieces are substantially crescent-shape.

3. The method of claim 1, wherein said scarf body fabric pieces are polygonal.

4. The method of claim 1, wherein said scarf body fabric pieces are substantially triangular.

5. The method of claim 1, wherein said stiffener is substantially crescent-shape.

6. The method of claim 1, wherein said stiffener comprises polycarbonate.

7. The method of claim 7, wherein said stiffener possesses a thickness of substantially about 0.0035 inches.

8. The method of claim 1, wherein said stiffener is flexible.

9. The method of claim 1, wherein said step of securing said two visor body fabric pieces together along a portion of their peripheral edges to form an envelope comprises stitching.

10. The method of claim 1, further comprising the step of securing at least a portion of said stiffener to said envelope after said step of inserting said stiffener into said envelope.

11. The method of claim 1, wherein said visor includes a concave edge portion dimensioned for conforming engagement with a human forehead.

12. The method of claim 1, wherein said two visor body fabric pieces comprise two different materials.

13. The method of claim 1, wherein said two visor body fabric pieces possess opposite sides having different appearances.

14. The method of claim 13, wherein said two visor body fabric pieces are placed in wrong-side-out orientation during said step of placing said two visor body fabric pieces in substantially overlying relation.

15. The method of claim 14, further comprising the step of turning said envelope right-side-out after said step of securing said two visor body fabric pieces together along a portion of their peripheral edges to form an envelope.

16. The method of claim 1, wherein said two scarf body fabric pieces comprise two different materials.

17. The method of claim 1, wherein said two scarf body fabric pieces possess opposite sides having different appearances.

18. The method of claim 17, wherein said two scarf body fabric pieces are placed in wrong-side-out orientation during said step of placing said two scarf body fabric pieces in substantially overlying relation.

19. A method of making a scarf with visor, comprising the steps of:

(1) providing a visor;
(2) providing two scarf body fabric pieces;
(3) placing said two scarf body fabric pieces in substantially overlying relation;
(4) placing said visor between said scarf body fabric pieces, with an edge portion of said visor disposed adjacent substantially overlying peripheral edges of said scarf body fabric pieces;
(5) securing peripheral edges of said substantially overlying scarf body fabric pieces and said edge portion of said visor to form a scarf, leaving a peripheral gap; and
(6) turning said scarf right-side-out by pulling said visor through said gap.

20. A method of making a reversible scarf with visor comprising the steps of:

(1) providing two crescent-shape fabric pieces from two different materials;
(2) providing a crescent-shape flexible polycarbonate stiffener;
(3) placing said two crescent-shape fabric pieces in substantially overlying wrong-side-out orientation;
(4) stitching said two crescent-shape fabric pieces together along their convex edges to form an envelope;
(5) turning said envelope right-side-out;
(6) inserting said stiffener into said envelope;
(7) stitching around the periphery of said envelope, through said stiffener, to form a visor;
(8) providing two isosceles right triangle-shape fabric pieces from two different materials;
(9) placing said two triangular fabric pieces in substantially overlying wrong-side-out orientation;
(10) placing said visor between said triangular fabric pieces, with a concave edge of said visor disposed substantially centrally between two vertices on a hypotenuse of said triangular fabric pieces;
(11) stitching around the periphery of said overlying triangular fabric pieces and through the concave edge of the visor to form a scarf, leaving an unsewn peripheral gap;
(12) turning said scarf right-side-out by pulling said visor through said unsewn gap; and
(13) stitching around the periphery of said scarf and through the concave edge of said visor.

* * * * *